United States Patent [19]

Caporaso, Jr. et al.

[11] Patent Number: 4,615,267

[45] Date of Patent: Oct. 7, 1986

[54] PORTABLE DATA RECORDER

[75] Inventors: Anthony J. Caporaso, Jr., Barrington; Dana W. Mox, Glenview, both of Ill.

[73] Assignee: Venture VII, Ltd., Chicago, Ill.

[21] Appl. No.: 733,330

[22] Filed: May 10, 1985

Related U.S. Application Data

[63] Continuation of Ser. No. 604,058, Apr. 26, 1984, abandoned, which is a continuation of Ser. No. 440,089, Nov. 8, 1982, abandoned.

[51] Int. Cl.[4] ..... B41F 3/04

[52] U.S. Cl. ..... 101/269; 101/270

[58] Field of Search ..... 101/45, 56, 269, 270, 101/271, 272, 273, 274

[56] References Cited

U.S. PATENT DOCUMENTS

| | | | |
|---|---|---|---|
| 3,608,485 | 9/1971 | Schulze | 101/269 |
| 3,739,718 | 6/1973 | Zupancic | 101/269 X |
| 3,800,700 | 4/1974 | McInnis et al. | 101/269 |
| 4,078,491 | 3/1978 | Schweers | 101/269 |
| 4,262,589 | 4/1981 | Gebhardt | 101/269 X |
| 4,324,181 | 4/1982 | Maul, Sr. | 101/269 |

FOREIGN PATENT DOCUMENTS

| | | | |
|---|---|---|---|
| 2447714 | 4/1976 | Fed. Rep. of Germany | 101/269 |
| 2504018 | 8/1976 | Fed. Rep. of Germany | 101/269 |
| 0133557 | 10/1979 | Japan | 101/269 |

OTHER PUBLICATIONS

IBM Technical Disclosure Bulletin, "Imprinter Having a Belt-Driven Imprint Roller" by Hagiwara, vol. 22, No. 7, 12-'79, pp. 2794-2795.

*Primary Examiner*—Edgar S. Burr
*Assistant Examiner*—John A. Weresh
*Attorney, Agent, or Firm*—Niro, Scavone, Haller & Niro Ltd.

[57] ABSTRACT

A portable, handheld data recorder for pressure-transfer printing embossed information onto a form set from a credit card or the like includes a push/pull platen assembly contained in a closed housing but manually operable from the exterior of the device. A releasable retainer also within the housing is provided for holding the form set in place during imprinting and again is manually operable from the exterior of the device. The recorder also includes resilient means for accommodating credit cards of different thicknesses.

9 Claims, 11 Drawing Figures

FIG. 8
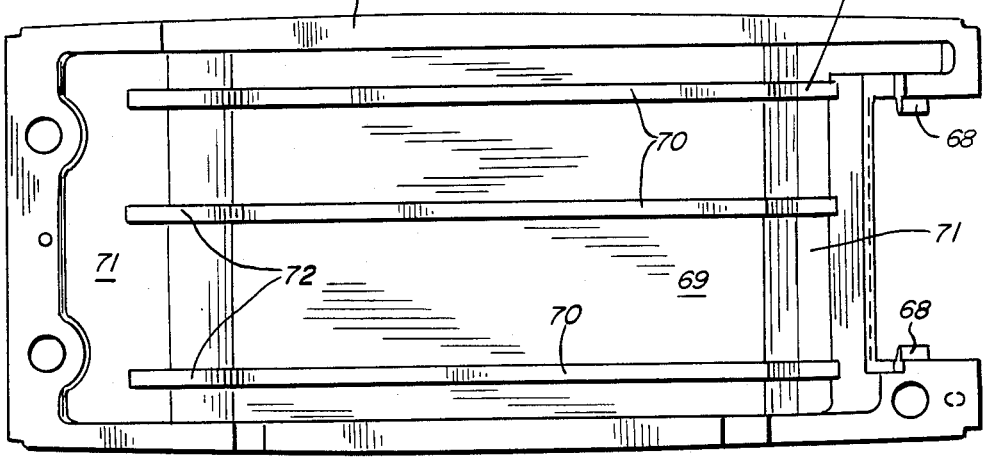
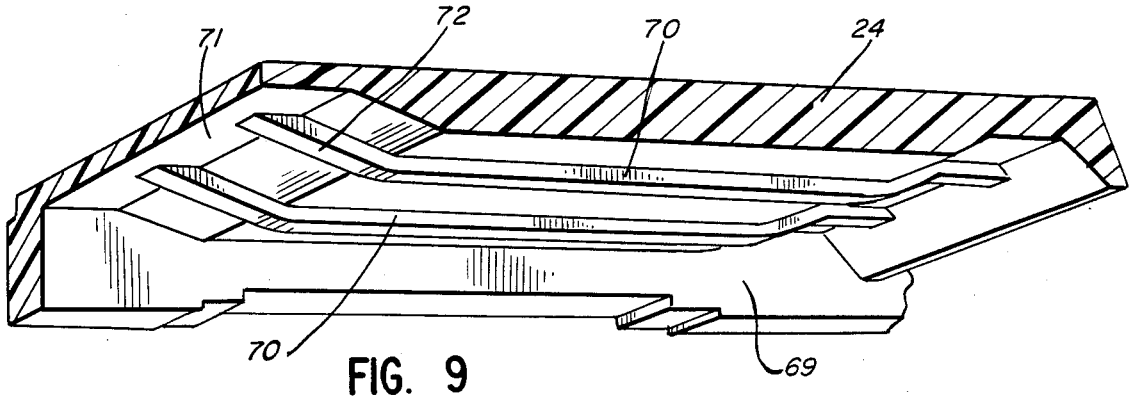
FIG. 9
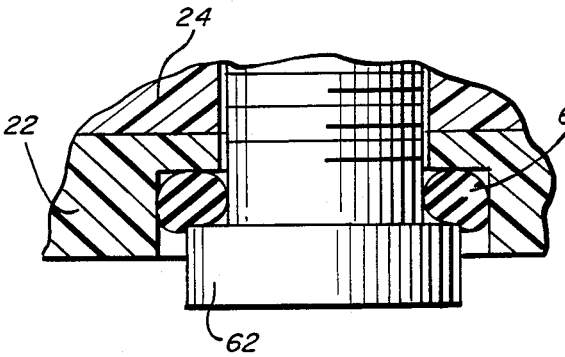
FIG. 10
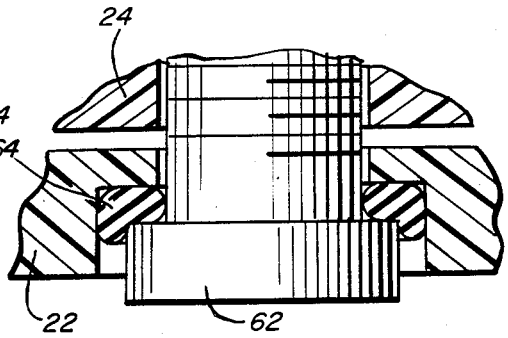
FIG. 11

PORTABLE DATA RECORDER

This application is a continuation of application Ser. No. 604,058 filed Apr. 26, 1984, now abandoned, which is a continuation of Ser. No. 440,089 filed Nov. 8, 1982 now abandoned.

BACKGROUND OF THE INVENTION

The present invention relates to a portable data recorder or an imprinter for pressure-transfer printing of embossed data from a relatively rigid substrate onto visually and/or machine readable data sheets. More specifically, the present invention relates to roller-platen imprinters for imprinting by rolling a platen across or over an embossed card or plate with a form set inserted between the platen and the card or plate during operation.

An imprinter is typically used to record information from embossed cards or plates of customers and others at many separate locations, such as retail merchants, service stations and hospitals. Imprinters may be automatic or manually operated for imprinting information embossed on one or more cards or plates onto multipart data sheets known as "form sets". Each form set has sheets of paper interleaved with carbon paper sheets. Information from the cards and plates is transferred by imprinting pressure applied through the form set to the embossed characters on these cards or plates by one or more platen rollers in the imprinter during one or more strokes of the imprinter carriage.

The technology of pressure imprinting of paper documents with carbon ribbons or carbon paper from embossed plates was first used in addressing machines in the 1890's. Imprinters were developed beginning in the late 1920's to repetitively enter address, customer, and other information onto forms in credit transactions, patient identification, and the like. Prior to the availability of imprinters and addressing machines, information was laboriously typed out or written by hand. As a result, errors were numerous, and the cost attendant to preparation and handling of the documents was high. Introduction of mechanical data recorders for use with embossed charge plates helped to avoid the problems of illegible handwriting and inaccurate entry of information in, for instance, retail credit transactions. The resulting sales slips were readily, although manually, processed also reducing the period of time the retail establishment was required to float the transaction.

In the early 1950's, automatic tab card processing machinery for use with optical scanning systems was developed. The petroleum industry, with its particularly heavy credit card volume, was the first to make use of the automatic processing and optical scanning technology. A standardized embossed character was developed for use on credit cards, and imprinters were designed to reproduce these characters with sufficient clarity to permit optical scanning and machine processing. Such systems not only eliminated the previously required manual processing, but achieved a decreased overall document rejection rate from nearly 40% to the 25% range. With this substantial reduction in manual handling, document processing costs were substantially decreased.

Until 1964, virtually all commercial imprinters in use in the United States employed a single platen roller which imprinted data in a single stroke of its platen carriage. Although these imprinters with the single imprinting strokes produced machine scannable documents, and the documents routinely were scanned, the single platen imprinters had a number of disadvantages. Because all lines of embossing on the credit card and station plate were being imprinted at one time on single stroke machines, the force required to move the carriage was high. In addition, the single platen roller often caused smudging on the form set. Further, tilting of the platen roller between the metal station plate and the plastic card left poor impressions in some areas on the form set. Finally, plastic credit cards were often damaged in the single platen imprinters.

This led to a variety of multiple platen and shifting platen designs which allowed for imprinting of the credit card with one platen and the station plate with another.

All of these developments led to a largely satisfactory imprinter design which is now embodied in the Addressograph-Farrington Models Nos. 14-800, 14-850, 14-900 and 14-950 series imprinters. These imprinters are countertop or tabletop machines which include platen assemblies containing rollers of approximately 1-½ inches outside diameter and an overall machine weight of 4–10 pounds, depending on model variations. The machines vary in size from approximately 6×12×4 inches to 6×12×10 inches, again depending on model variations.

The major disadvantages found in current imprinter design is that the machines are required to be centrally located, not being readily portable. The major advantage of these designs is the overall low rejection rate of scanned documents, which is generally less than 5% due to machine imprint error. While portability of the machine has obvious advantages, such as elimination of a central imprinter location and the lost time associated therewith, a simple reduction in size and weight of the machine is not possible because of the critical interrelationship between size, weight, and function which has developed over the long history of imprinter design.

Specifically, the imprinter design is required to provide a pressure force between the platen and embossed card or plate sufficient to generate a clear, distinct impression of the transferred information so that machine scanning is possible. In order to accomplish this, the machine components must be rigid enough that during imprinting the relationship between the platen, the card or plate, and the base supporting the card or plate remains relatively fixed to guarantee a fairly constant imprinting pressure. In addition, the design must permit the application of imprinting pressure by rolling the platen or platens across the form set and cards with a small enough motive force that it can be easily operated by the average user, i.e., a retail sales clerk.

Over the years, a relatively fixed design constant has developed which is not readily translated into a down-sized and portable model. As weight and size are reduced, rigidity is sacrificed. As rigidity is increased, ease of operation is sacrificed. As rigidity and operation are controlled, down-sizing is sacrificed. As a consequence, no truly portable, lightweight pressure-transfer imprinter has been adopted for use in the credit card industry.

Another problem associated with such pressure-transfer imprinters is the requirement that they operate satisfactorily with embossed credit cards of different thicknesses. For example, the industry-standard thickness dimension for a new credit card is approximately 0.048 inch, but over its useful life the card's thickness may be reduced to 0.040 inch. As a consequence, prior art imprinters have utilized relatively complex design components to accommodate different card thicknesses, and such components have contributed to both the size and weight of the imprinter, making portability of the machines even less practical.

SUMMARY OF THE INVENTION

The present invention balances all of the above-mentioned opposing design criteria, including rigidity, size and ease of operation, to provide a small, portable, lightweight imprinter which requires a motive force approximating that of its larger predecessors and which provides an imprint having approximately the same scannability as the recognized standards of the current designs even with credit cards of different thicknesses. No other portable imprinting device has even approximated these goals.

The present invention is, therefore, directed to a portable, handheld data recorder for imprinting from cards and plates the embossed information contained on such cards or plates. The embossed information is pressure-transfer imprinted onto a typical form set by moving the roller platen assembly of the imprinter across its bed or base plate to apply pressure to the embossed cards and/or plates and the form set disposed therebetween.

The imprinter is designed to be readily portable, weighing less than approximately one pound and having outer dimensions of approximately $6.5\times3\times1$ inches. This compact design is uniquely adapted for easy operation, requiring approximately the same platen pull force, i.e., about less than 3 pounds, as its larger predecessors, while still being able to provide sufficient imprint pressure to produce a quality print and readily scannable documents. Thus, the unique design features of the present invention preserve and enhance the rigidity of the machine, permitting overall weight and size to be substantially reduced from the imprinters of the prior art, without sacrificing operability or function.

The design of the present invention also includes a unique platen arrangement which permits reduction in platen size to approximately one-quarter of heretofore accepted standards. The imprint quality produced by this design is equal to and often exceeds the imprint quality produced by many larger machines. The platen arrangement permits each scannable line of information to be imprinted independently of all other data lines by providing an independent, dedicated platen roller which engages only the particular scannable data line.

Also, unique form set hold-down means are provided which eliminate or reduce the size and number of form stops on the bed or base plate of the machine. This permits a reduction in overall size and further, increases the flexibility of the imprinter by allowing both 51 and 80 column forms to be used in a single machine.

Additional features include special ribbing in the imprinter components to provide greater rigidity without increased weight or density, and a unique credit card holder which positively holds the embossed printing element in place during imprinting.

Finally, the present invention includes a unique biasing means which permits the use of the data recorder with different thickness credit cards, but without increasing either the size or weight of the apparatus in any significant manner.

Other features, enhancements and advantages of the present invention will be readily apparent by reference to the attached drawings and description of the preferred embodiments. While specific features are described in detail, this description is not intended to be limiting, with the scope and spirit of the invention being fully and clearly set forth in the Claims appended to this specification.

BRIEF DESCRIPTION OF THE DRAWINGS

FIG. 8 is a plan view showing the inside of the upper housing of the portable data recorder, having pressure-applying rails constructed in accordance with the teachings of the present invention.

FIG. 9 is a perspective cross-sectional view taken along line 9—9 of FIG. 2.

FIG. 10 is a partial cross-sectional view taken along line 10—10 of FIG. 5, illustrating the unique biasing means of the present invention.

FIG. 11 is also a partial cross-sectional view, similar to that of FIG. 10, but taken along line 11—11 of FIG. 4 and showing the unique biasing means when stressed to accommodate a credit card during the imprinting operation.

DETAILED DESCRIPTION OF THE PREFERRED EMBODIMENTS

Figures 1, 2:
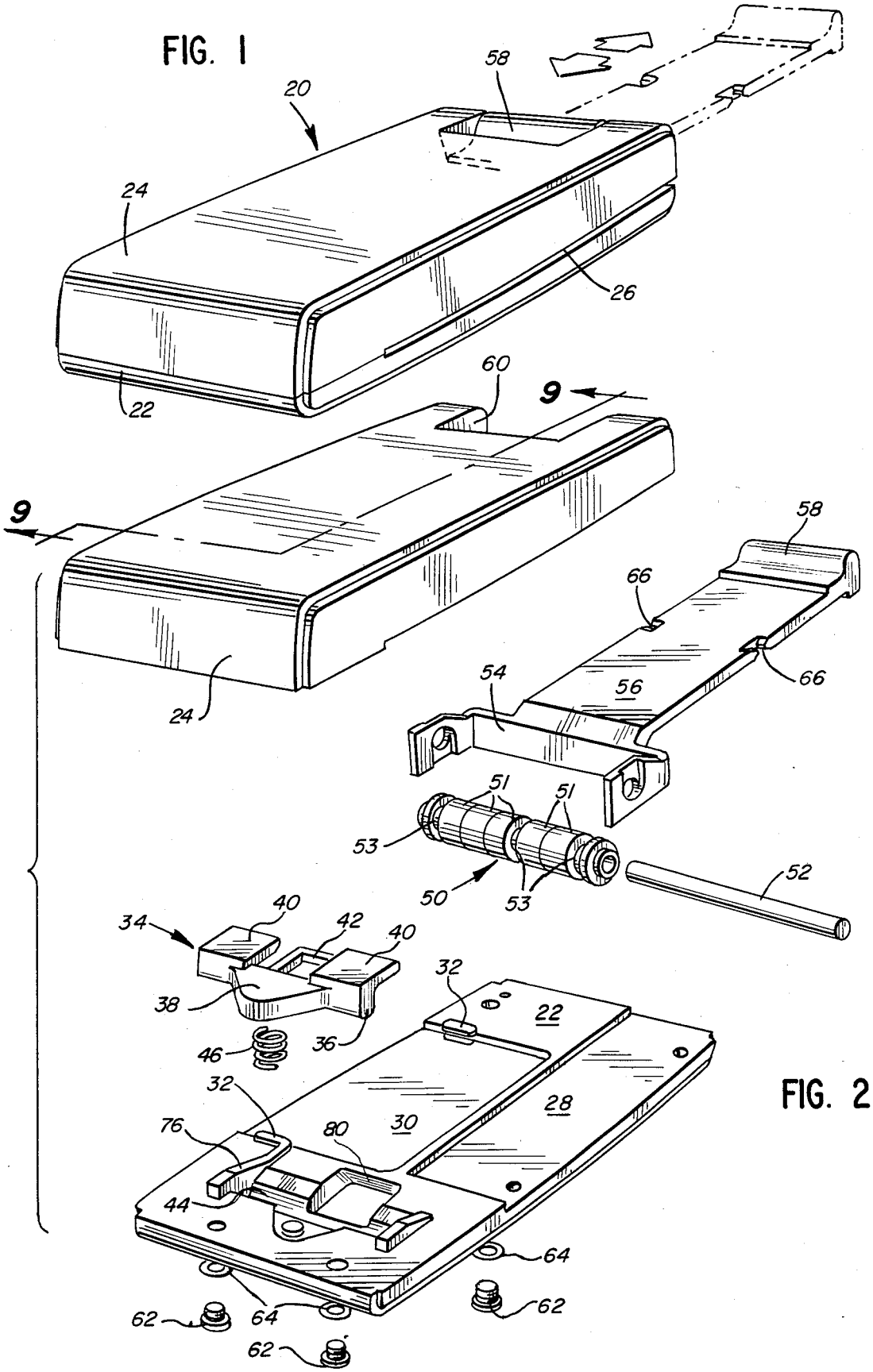
FIG. 1 is a perspective view of a portable data recorder designed in accord with the teachings of the present invention, and showing, in phantom, the movement of the platen assembly pull bar and handle between a first, retracted position and a second, fully extended position.
FIG. 2 is an exploded perspective view of the data recorder of the present invention shown in FIG. 1.

The portable recorder of the present invention, designated generally as 20, is illustrated in FIG. 1, and includes a base plate 22 and upper housing 24 secured to the base plate. The upper housing includes a cut away portion along one side and one end to define the form set insert slot 26.

An exploded perspective view of the imprinter 20 is shown in FIG. 2. The base plate 22 includes recesses 28 and 30 for receiving a standard station plate and credit card, respectively. At least one of recesses 28 and 30 includes a slotted retaining member positioned at its perimeter for securely holding the printing element therein while preventing misalignment or misplacement of the printing element with respect to the form set. Preferably, a plurality of slotted retainers 32 are mounted on the base plate around the perimeter of the recess 30, whereby the credit card, when positioned in the recess, is securely held during imprinting. After the plate and card have been inserted, they form with the upper surface 25 of the base plate a relatively flat surface for supporting a typical form set to be imprinted.

The data recorder includes a form set hold-down structure 34, including a pivotable axis 36, and a biasing arm 38, two hold-down pads 40 and an activator button 42, each of which is integrally formed with axis 36. The hold-down structure 34 is disposed within a complimentary recess 44 in the base plate with compression spring 46 disposed therebetween. The biasing force of spring 46 causes the hold-down structure to pivot about axis 36, with the pads 40 urged into contact with surface 25 of the base plate.

The data recorder utilizes a platen assembly including a roller platen assembly 50 mounted, via shaft 52, on a yoke 54. The yoke 54 is disposed at one end of an elongated platen assembly pull bar 56 which includes a handle 58 at its opposite end. As can be seen in FIGS. 1 and 2, the upper housing 24 includes a recessed portion 60 which accommodates handle 58 when the platen assembly is fully retracted. Roller platen assembly 50 includes roller platens 51 and rail rollers 53 of greater and lesser outside diameters, respectively, which define on said roller platen assembly an outer land area for imprinting purposes and an inner, recessed land area for transmittal of imprinting pressure to the form set and embosed printing elements. The outer and inner lands also define a stepped surface on the roller platen assembly 50 which cooperates with complimentary rails, described below, to facilitate proper tracking of the platen assembly. Roller platens 51 also define an alignment groove positioned intermediate the roller platens.

The upper housing 24 is secured to base plate 22 by means of at least one, and preferably a plurality of, fastening means such as screws 62. In accord with the teachings of the invention, the fastening means also includes a resilient component, such as elastromeric o-rings at 64, whose function will be described in greater detail below.

It should also be noted that pull bar 56 includes opposed notches 66 which are dimensioned to slide over tabs 68 (see FIGS. 4, 5 and 8) when the pull bar is perpendicular to the longitudinal axis of housing 24 during assembly, but which are too small to permit removal over tabs 68 when the pull bar is in its operative, parallel orientation within housing 24.

Figure 3:
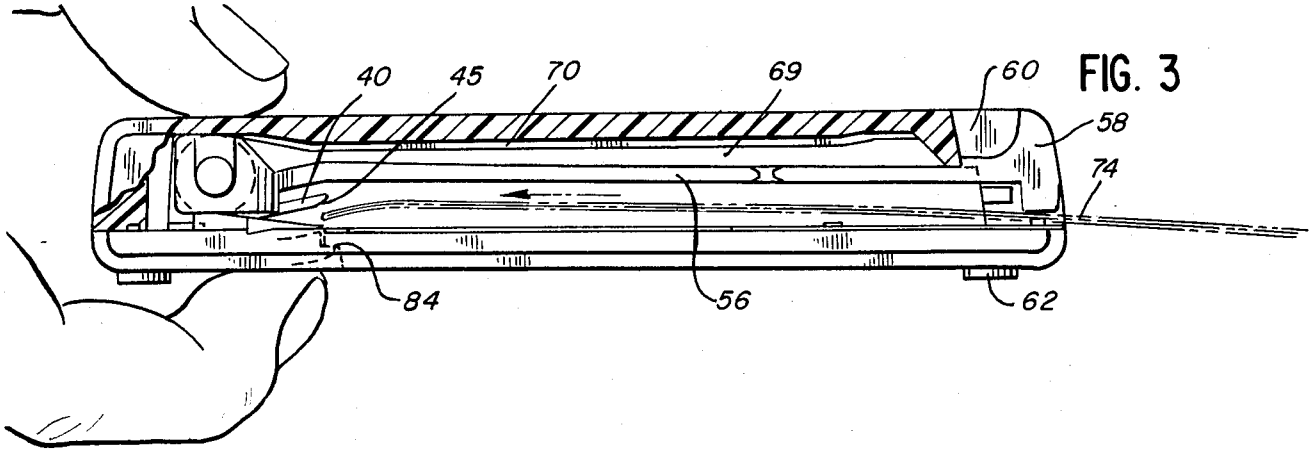
FIG. 3 is a partial cross-sectional view of the data recorder shown in FIG. 1, further illustrating the operation of the unique form set hold down mechanism and with the platen assembly in its first position.
Figure 4:
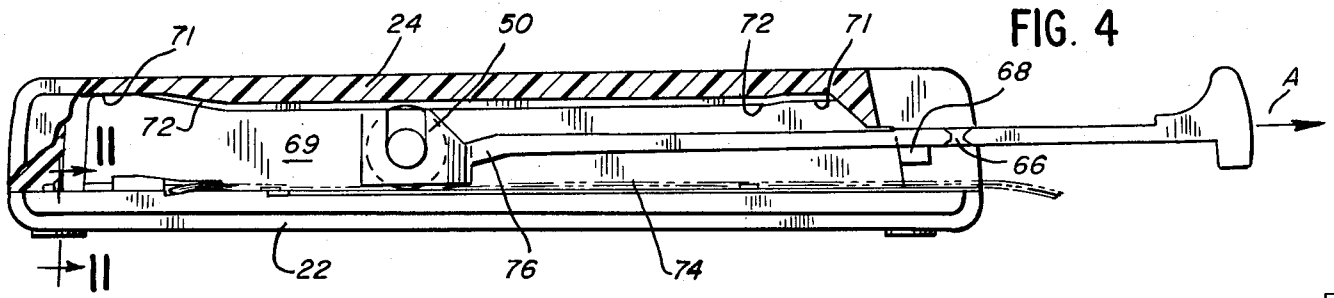
FIG. 4 is a partial cross-sectional view similar to that of FIG. 3, but illustrating the platen assembly midway along its path of travel from the first, retracted position to the second, extended position during the imprinting operation.
Figure 5:
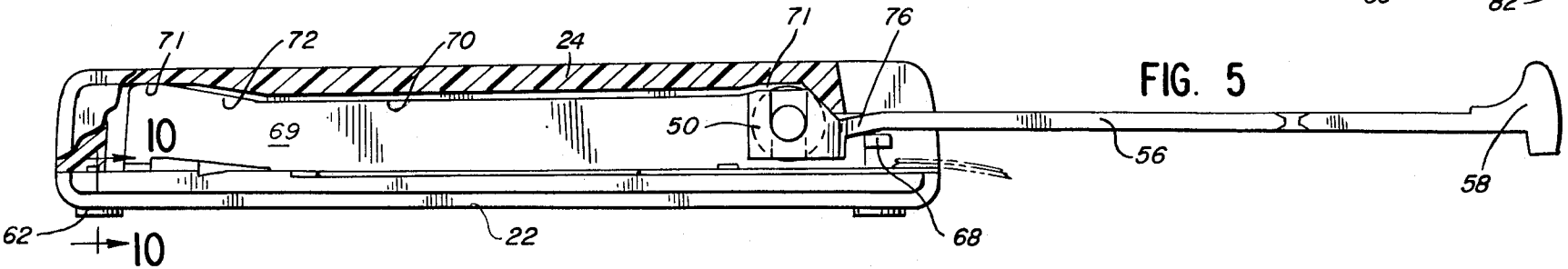
FIG. 5 is again a partial cross-sectional view similar to that of FIG. 3, but in this view illustrating the platen assembly in its fully extended position after completion of the imprinting operation.

With reference now to FIGS. 3–9, further structural details and the operation of the portable data recorder 20 will be described. The upper housing 24 includes an internal cavity 69 and at least one and preferably a plurality of elongated raised rails 70, which are disposed within cavity 69 and directly engage roller platen 50 during the imprinting operation. Elongated raised rails 70 extend in the direction of cavity 69 and are spaced such that rails are positioned on either side of the cavity having at least one intermediate rail therebetween. As can be seen in FIGS. 3–5, the cavity 69 has recessed areas 71 and the rails 70 have inclined end portions 72 which permit the roller platen assembly 50 to raise or lift from the form set 74 and base plate 22 when at either the first, retracted position (FIG. 3) or the second, extended position (FIG. 5). As the roller platen assembly moves across the form set, credit card, station plate and base plate during imprinting (FIG. 4), the rails 70 directly engage the platen assembly via rail rollers 53 to thereby direct the roller platens 53 into pressure engagement with the form set. Thus, a unidirectional motive force applied to handle 58 (see arrow A in FIG. 4) produces two force components in the roller platens—one to move the platens horizontally across the form set and embossed printing elements, and a second to move the platens down into pressurized engagement with the form set.

The lifting action of the roller platen assembly 50 is accomplished at the first position by ramps 76 (see FIG. 2 as well) and at its second position by the offset neck 78 of pull bar 56 in operative engagement with tabs 68.

Figure 6:
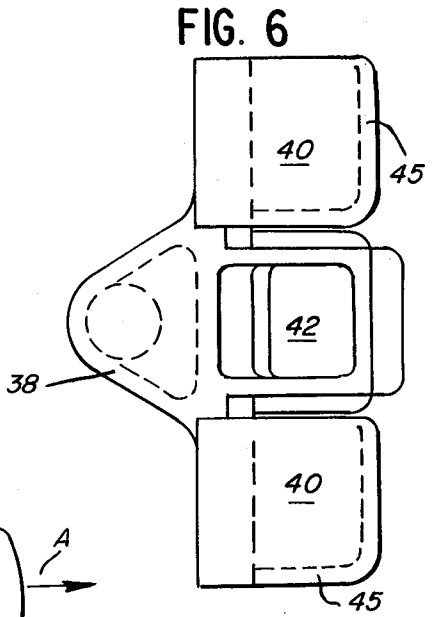
FIG. 6 is a plan view showing the structure of the unique hold down means employed in the present invention.
Figure 7:
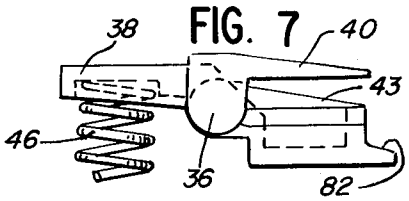
FIG. 7 is a side elevational view of the hold down means illustrated in FIG. 6.

The unique hold-down structure of the present invention is further illustrated in FIGS. 3, 6 and 7. The hold-down structure 34 is positioned such that its activator buttom 42 is disposed within aperture 80 (see FIG. 2) and is biased outwardly by spring 46. The aperture 80 makes the buttom 42 accessible from the outside of the data recorder, and by manually depressing the button as shown in FIG. 3, the hold-down pads 40 are raised from upper surface 25 of base plate 22 to permit insertion of the form set. After the form set is properly positioned, the buttom 42 is released and the biasing force of spring 46 will urge the pads 40 into holding contact with the form set. Button 42 includes a stop tab 82 which cooperates with a shoulder 84 on aperture 80 to insure that the upper surface 43 of button 42 does not interfere with the full and proper insertion and positioning of the form set. Finally, the pads 40 have inclined leading edges 45 to minimize the interference of pads with proper insertion of the form set 74.

As previously noted, base plate 22 includes a recess 28 for receipt of a conventional station plate and a recess 30 for receipt of a credit card. These two recesses, therefore, define two printing areas that extend across the data recorder—areas that must be traversed by the roller platen assembly 50. Because of the relatively small diameter of the roller platen assembly, it is desirable to uniformly distribute the imprinting forces across these printing areas, and, to that end, the rails 70 are positioned as shown in FIG. 8 such that one rail is located between the two printing areas and the other rails are each located adjacent an opposite outside edge of the printing areas. Positioning rails 70 in this manner allows a self adjusted, predetermined and uniformly distributed printing pressure to be applied to roller platen assembly 50 as the roller platen assembly is moved within cavity 69.

Rails 70 also provide necessary rigidity to the upper housing 24 which is necessary in view of its relatively small size. Moreover, the rails also act as tracks which properly orient the roller platen assembly as it travels to and from retracted and extended positions. To this end the rail intermediate the two printing areas is positioned within the alignment groove disposed between roller platens 51. Construction in this manner allows the platen assembly 50 to be properly positioned with respect to the form set and/or the printing element and provides predetermined, automatically adjusted and uniformly distributed printing pressure between the roller platen assembly, the form set and the printing elements.

FIGS. 10 and 11 illustrate in greater detail the operation of the resilient housing assembly components that facilitate the use of the data recorder with cards of different thickness. In accord with this aspect of the invention, the upper housing 24 is secured to the base plate 22 by means of screws 62 with a resilient, elastomeric o-ring 64 disposed between the head of the screw and the base plate. As a consequence, with no load or with a very thin credit card, the housing 24 and base plate 22 will remain essentially contiguous as shown in FIG. 10. However, when imprinting with a printing element of greater thickness—such as a new credit card—the o-ring 64 will compress allowing movement of the base plate 22 relative to the housing 24 as shown in FIG. 11. This unique resilient assembly technique requres no increase in size of the data recorder and virtually no increase in weight and thereby greatly enhances the portability of the machine.

The entire portable data recorder 20 is made of small, lightweight components. The base plate, upper housing, hold-down structure, platen yoke, pull bar and handle may all be injection molded from lightweight plastics with the result that the entire machine will weigh less than approximately one pound. In addition, its size, approximately $6.5\times3\times1$ inches permits its easy storage in a attache case, purse or pocket. Finally, the form set and credit cards can be easily inserted and removed from the recorder without disassembly of any component of the apparatus, and clean, machine-readable imprints can be made with a single stroke of the platen assembly using a motive force well within industry-accepted standards.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

What is claimed is:

1. A portable imprinter for pressure-transfer imprinting on a form set the information contained on an embossed printing surface, comprising:

a two-peice, light-weight apparatus including an upper housing having an elongated internal cavity, and a lower base plate defining the base of said cavity for supporting at least one printing element having an embossed printing surface and a form set to be imprinted;

a platen assembly within said cavity, including an elongated pull bar extending in the direction of said elongated cavity, a cylindrical platen roller rotatably mounted at one end of the pull bar within the cavity, and a handle at the other end of the pull bar and disposed outside said housing for manually moving the platen roller between first and second positions across the form set and printing element within the cavity, said platen roller including a shaft, first roller portions on the shaft having greater diameters defining out land means for engaging the form set and effecting imprinting, and second roller portions on the shaft having lesser diameters defining inner land means at opposite ends of the platen roller and alignment groove means intermediate the ends of the platen roller;

cam means in the form of at least three raised rails formed integrally with the underside of said upper housing extending in the direction of said elongated cavity and spaced such that first and second end rails are positioned on either side of said elongated cavity having at least one intermediate rail therebetween, said rails in combination applying a self adjusted and uniformly distributed printing pressure to said platen roller as said platen roller is moved within said internal cavity, at least said first and second end rails camming the platen roller into contact with the form set or the printing element, said intermediate rail positioned within said alignment groove means for positioning said platen roller with respect to at least one of said form set and said printing element and for developing said self adjusted and uniformly distributed printing pressure therebetween, said rails including inclined ends for reducing the pressure applied to the platen roller as it approaches the limits of its movement;

resiliently biased holding means mounted on said base plate within said cavity for holding the form set in place during imprinting, and including means accessible from the outside of the imprinter through the base plate for releasing the resiliently biased holding means for loading and unloading the form set in the imprinter;

recess means on said base plate within said cavity for receiving the printing element, and slotted retainer means on the base plate around the perimeter of the recess means for securely holding the printing element in the recess means; and means for securing said upper housing and lower base plate in assembled relation with said platen assembly within said cavity.

2. The portable imprinter of claim 1 wherein said upper housing is resiliently secured to said base plate, whereby said imprinter may accommodate printing elements of different thicknesses.

3. The portable imprinter of claim 2 wherein said upper housing is secured to said base plate by at least one fastening device including a resilient member.

4. The portable imprinter of claim 3 wherein said resilient member is an elastomeric o-ring.

5. The portable imprinter of claim 1 wherein said base plate supports two separate printing elements, each positioned in a different one of two printing areas within said cavity; and including three elongated raised rails, one rail positioned between said printing areas and the other rails each positioned adjacent a different outside edge of said printing areas, allowing the forces applied by said platen roller to said form set and printing elements to be self adjusted and uniformly distributed.

6. The portable imprinter of claim 1 further including a recess for receiving the handle when the platen assembly is in the first position.

7. The portable imprinter of claim 1 wherein the form set holding means comprises a pivotable retainer mounted within said cavity; resilient means for normally urging the retainer toward the base plate to hold the form set disposed therebetween during imprinting; and an activator accessible from the outside of said imprinter for overcoming the resilient means and pivoting the retainer away from the base plate to permit insertion and removal of the form set.

8. A portable imprinter for pressure-transfer imprinting on a form set the information contained on an embossed printing surface, comprising:

a two-piece, light-weight apparatus including an upper housing having an elongated internal cavity, and a lower base plate defining the base of said cavity for supporting two printing elements, each positioned in a different one of two printing areas, having an embossed printing surface and a form set to be imprinted;

a platen assembly within said cavity, including an elongated pull bar extending in the direction of said elongated cavity, a cylindrical platen roller rotatably mounted at one end of the pull bar within said cavity, and a handle at the other end of the pull bar and disposed outside said housing for manually moving the platen roller between first and second positions across the form set and printing element within the cavity, said platen roller including a shaft, first roller portions on the shaft having greater diameters defining outer land means for engaging the form set and effecting imprinting, and second roller portions on the shaft having lesser diameters defining inner land means at opposite ends of the platen roller and alignment groove means intermediate the ends of the platen roller;

cam means in the form of three elongated raised rails formed integrally with the underside of said upper housing extending in the direction of said elongated cavity, one rail positioned between said two printing areas and the other rails each positioned adjacent a different outside edge of said printing areas to apply predetermined, automatically adjusted and uniformly distributed forces to said form set and said printing elements through said platen roller, at least said first and second end rails camming the platen roller into contact with the form set or the printing element, said intermediate rail positioned within said alignment groove means for positioning said platen roller with respect to at least one of said form set and said printing element, said rails extending from said first and second positions and including inclined ends for reducing the pressure applied to the platen roller as it approaches the limits of its movement;

resiliently biased holding means mounted on said base plate within said cavity for holding the form set in place during imprinting, and including means accessible from the outside of the imprinter through the base plate for releasing the resiliently biased holding means to position the form set with respect to the imprinter;

recess means on said base plate within said cavity for receiving the printing element, and slotted retainer means on the base plate around the perimeter of said recess means for securely holding the printing element therein; and means for securing said upper housing and lower base plate in assembled relation with said platen assembly within said cavity.

9. A portable imprinter for pressure-transfer imprinting on a form set the information contained on an embossed printing surface, comprising:

a two-peice, light-weight apparatus including an upper housing having an elongated internal cavity, and a lower base plate defining the base of said cavity for supporting two printing elements, each positioned in a different one of two printing areas, having an embossed printing surface and a form set to be imprinted, at least one of said printing areas including a recess on said base plate within said cavity for receiving at least one of said printing elements, a slotted retainer on the base plate positioned at the perimeter of said recess for securely holding said printing element therein;

a platen assembly within said cavity, including an elongated pull bar extending in the direction of said elongated cavity, a cylindrical platen roller rotatably mounted at one end of the pull bar within said cavity, and a handle at the other end of the pull bar and disposed outside said housing for manually moving the platen roller between first and second positions across the form set and printing element within the cavity, said platen roller including a shaft, first roller portions on the shaft having greater diameter defining outer land means for engaging the form set and effecting imprinting, and second roller portions on the shaft having lesser diameters defining inner land means at opposite ends of the platen roller and alignment groove means intermediate the ends of the platen roller;

three elongated raised rails formed integrally with the underside of said upper housing extending in the direction of said elongated cavity, one rail positioned between said two printing areas and the other rails each positioned adjacent a different outside edge of said printing areas to apply predetermined, automatically adjusted and uniformly distributed forces to said form set and said printing elements through said platen roller, said first and second end rails camming the platen roller into contact with the form set or the printing element, said intermediate rail positioned within said alignment groove means for positioning said platen roller with respect to at least one of said form set and said printing element and for applying said predetermined, automatically adjusted and uniformly distributed printing pressure between said platen roller and each of said printing elements, said rails extending from said first and second positions and including inclined ends for reducing the pressure applied to the platen roller as it approaches the limits of its movement;

resiliently biased holding means mounted on said base plate within said cavity for holding the form set in place during imprinting, and including means accessible from the outside of the imprinter through the base plate for releasing the resiliently biased holding means to position the form set with respect to the imprinter; and means for securing said upper housing and lower base plate in assembled relation with said platen assembly within said cavity.

* * * * *